US005975687A

United States Patent [19]

Powers

[11] Patent Number: 5,975,687

[45] Date of Patent: Nov. 2, 1999

[54] INSERTABLE BAFFLE FOR AN INK SUPPLY RESERVOIR

[75] Inventor: James Harold Powers, Lexington, Ky.

[73] Assignee: Lexmark International, Inc., Lexington, Ky.

[21] Appl. No.: 08/554,426

[22] Filed: Nov. 6, 1995

[51] Int. Cl.[6] ..... B41J 2/175

[52] U.S. Cl. ..... 347/86; 347/87

[58] Field of Search ..... 347/87, 86, 85, 347/84; 220/563, 564

[56] References Cited

U.S. PATENT DOCUMENTS

| | | | |
|---|---|---|---|
| 136,813 | 3/1873 | Clark | 220/564 |
| 1,562,074 | 11/1925 | Baum | 220/563 |
| 4,463,362 | 7/1984 | Thomas | 347/86 |
| 4,484,202 | 11/1984 | Sayko | 347/94 |
| 4,631,558 | 12/1986 | Hara | 347/86 |
| 5,408,257 | 4/1995 | Hiramatsu et al. | 347/92 |
| 5,444,473 | 8/1995 | Hattori et al. | 347/87 |
| 5,477,255 | 12/1995 | Huth | 347/87 |

*Primary Examiner*—Peter S. Wong
*Assistant Examiner*—Gregory J. Toatley, Jr.
*Attorney, Agent, or Firm*—Ronald K. Aust

[57] ABSTRACT

A baffle assembly for insertion into an ink supply reservoir includes a first baffle plate having a first end and a second end, wherein a first end plate is coupled to the first end of the first baffle plate and a second end plate is coupled to the second end of the first baffle plate. The first baffle plate, the first end plate, and the second end plate form an integral structure. When the baffle assembly is inserted into the ink supply reservoir, a distance, "b", between the first baffle plate and an adjacent side-wall of the ink supply reservoir satisfies the inequality relationship $b<(g/a)Dm/2k$, wherein "g" is the local acceleration of gravity; "a" is the acceleration experienced by the ink supply reservoir during a change in a travel direction, "Dm" is the change in an ejected ink drop mass due to a change in an ink reservoir pressure in the ink supply reservoir, and "k" is a slope of the ink drop mass versus the ink reservoir pressure. The baffle assembly loosely divides a volume of the ink supply reservoir into a plurality of smaller compartments. An ink flow between the plurality of compartments may be provided by a gap between the baffle plates and the floor of the ink supply reservoir.

31 Claims, 3 Drawing Sheets

INSERTABLE BAFFLE FOR AN INK SUPPLY RESERVOIR

FIELD OF THE INVENTION

The present invention is related to a baffled ink supply reservoir, and more particularly, to a baffle assembly for insertion into an ink supply reservoir.

BACKGROUND OF THE INVENTION

Baffle elements have long been used to limit the amount of movement of the liquid in a reservoir. Baffles have been incorporated into ink jet print head cartridges to reduce the mass of the liquid ink allowed to slosh unimpeded by the containing walls of the ink supply reservoir. The use of baffles in ink reservoirs has been disclosed, for example, in U.S. Pat. Nos. 5,408,257; 4,631,558; 4,484,202; and 4,463,362. Prior baffles incorporated into ink supply reservoirs are integral with, or permanently attached to, at least one of the walls forming the ink supply reservoir.

U.S. Pat. No. 5,408,257 discloses an ink tank, or reservoir, having an inner wall portion or member attached to the bottom face of a sub-tank, and arranged in a diagonal direction to prevent ink in the sub-tank from vibrating greatly.

U.S. Pat. No. 4,631,558 discloses an ink liquid reservoir mounted on a reciprocating cartridge in an ink jet system printer having a plurality of standing plates that are disposed in the ink liquid reservoir in a manner such that the top free edge of the standing plates are separated from the sealing wall of the ink liquid reservoir. The standing plates are secured to the bottom wall of the ink liquid reservoir.

U.S. Pat. No. 4,484,202 discloses an ink reservoir containing a plurality of vertically arranged baffles, or plate elements. The plate elements create a series of narrow compartments. An opening is provided in each baffle plate to enable flow of ink fluid among the separate compartments formed by the baffles. The baffles constrain excessive movement of the ink into narrow spaces as the print head is moved in a lateral direction by an appropriate carriage during the printing operation.

U.S. Pat. No. 4,463,362 discloses an ink reservoir which includes a plurality of baffles to provide individual ink tanks for print heads and to prevent or substantially minimize the sloshing motion of the ink as the reservoir is accelerated and decelerated during the printing operation. The baffles are in the form of plates extending from the front wall to the rear wall of the reservoir and are formed as an integral part of the reservoir at the floor thereof. A plurality of apertures are provided in the baffle plates near the bottom thereof and located near the rear wall of the reservoir for equalizing the levels of ink in the respective baffle-formed chambers or tanks.

Regardless of whether the baffles are formed integral with the ink supply reservoir body, or are later attached to one or more of the walls of the ink reservoir body, the baffles form rigid structures which generate shock waves within the ink as the ink is sloshed from side-to-side in the ink supply reservoir. Furthermore, ink supply reservoirs having rigidly mounted baffles are complex to manufacture, in that either the baffles must be formed as a part of the reservoir body during the molding process, or the baffles are separately molded from the reservoir body and attached to one or more walls of the ink supply reservoir after the ink supply reservoir is molded, thereby requiring additional steps in its manufacture.

SUMMARY OF THE INVENTION

The invention provides a baffle assembly for insertion into an ink supply reservoir. The baffle assembly includes a first baffle plate having a first end and a second end, wherein a first end plate is coupled to the first end of the first baffle plate and a second end plate is coupled to the second end of the first baffle plate. In preferred embodiments of the invention, the first baffle plate, the first end plate, and the second end plate form an integral structure.

When the baffle assembly is inserted into the ink supply reservoir, a distance, "b", between the first baffle plate and an adjacent side-wall of the ink supply reservoir satisfies the relationship $b<(g/a)Dm/2k$, wherein "g" is the local acceleration of gravity, "a" is the acceleration experienced by the ink supply reservoir during a change in a travel direction, "Dm" is the change in an ejected ink drop mass due to a change in an ink reservoir pressure in the ink supply reservoir, and "k" is a slope of the graph of ink drop mass versus the ink reservoir pressure.

The baffle assembly loosely divides a volume of the ink supply reservoir into a plurality of smaller compartments. An ink flow between the plurality of compartments may be provided by establishing a gap between the first baffle plate and the floor of the ink supply reservoir.

The baffle assembly, or the baffle plate, may be formed from a material different from a material from which the ink supply reservoir is formed. In such a case, for example, the baffle plate is formed from a compliant material, such as for example, plastic, rubber or metal.

In some embodiments of the invention, the baffle assembly is sized to allow the assembly to move in the ink supply reservoir in a direction parallel to a direction of motion of a printer carriage.

In other preferred embodiments, the baffle assembly described above further includes a second baffle plate arranged substantially parallel to the first baffle plate, wherein the second baffle plate has a first end and a second end, and wherein the first end plate is coupled to the first end of the second baffle plate and the second end plate is coupled to the second end of the second baffle plate. In such an assembly, it is preferred that a distance, "b", between the first baffle plate and the second baffle plate satisfies the algebraic relationship set forth above.

Other features and advantages of the invention may be realized from the drawing and detailed description of the invention that follows.

DETAILED DESCRIPTION OF THE PREFERRED EMBODIMENTS

Figure 1:
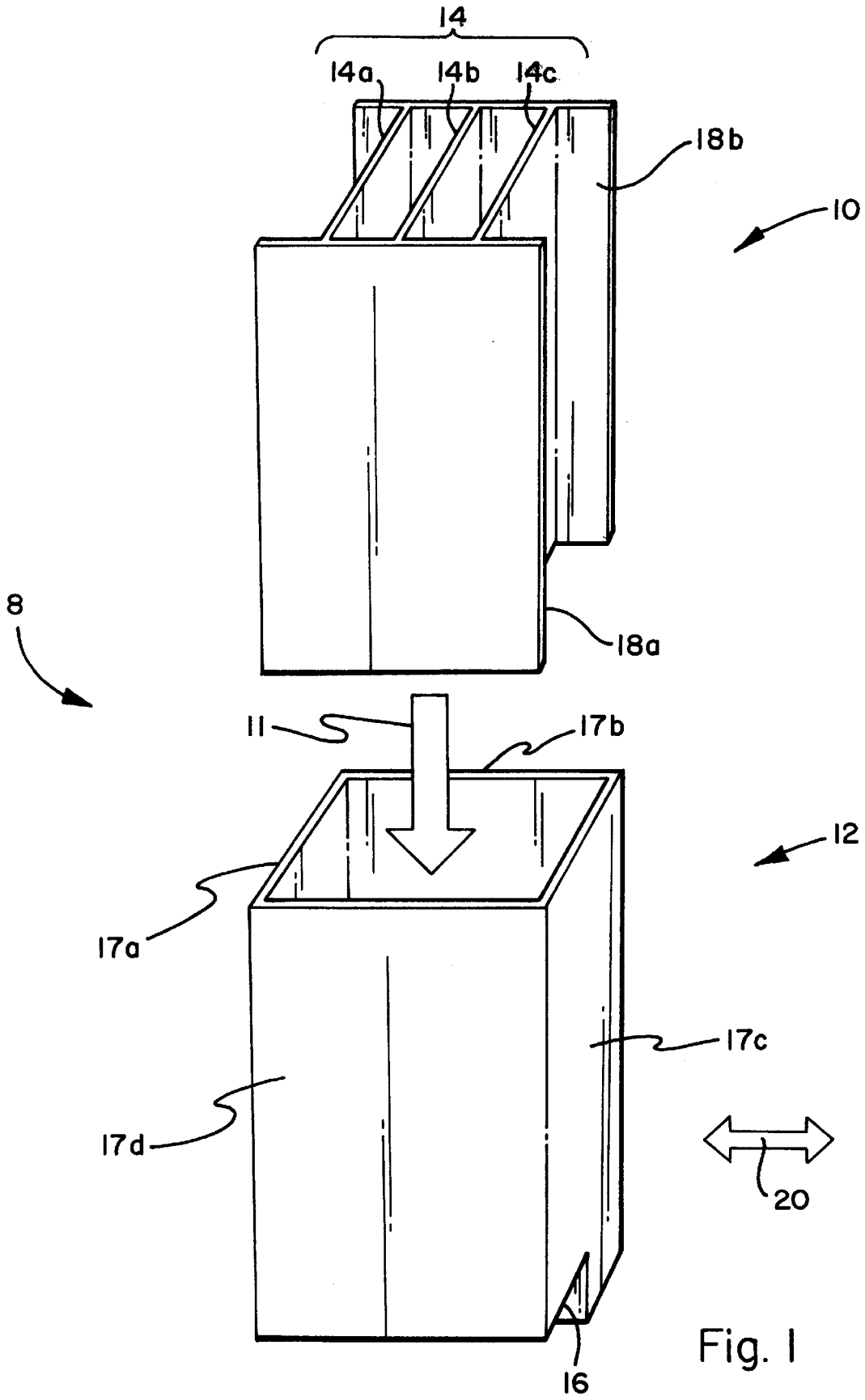
FIG. 1 shows a perspective view of a baffle insert of the invention.

FIG. 1 shows a baffle insert 10 suitable for insertion in the direction indicated by arrow 11 into an ink supply reservoir body 12, such as can be found in an ink jet printhead cartridge. Baffle insert 10 includes at least one baffle plate 14, and as shown in FIG. 1, can include a plurality of baffle plates 14, which are individually identified as baffle plates

14*a*, 14*b*, and 14*c*. Reservoir body 12 includes a floor wall 16 and sidewalls 17*a*, 17*b*, 17*c* and 17*d*.

Baffle plates 14 are arranged to be substantially perpendicular to the floor 16 of reservoir body 12. Furthermore, when a plurality of plates 14 are used, the plates 14 are oriented such that the plane of each plate is substantially parallel to the adjacent plate. Each baffle plate is oriented to be substantially parallel to reservoir side-walls 17*a* and 17*c*. The orientation and spacing of plates 14 are maintained by end plates 18*a* and 18*b*. End plates 18*a* and 18*b* may be formed integral with baffle insert 10 during a molding process, or may be attached to the baffle plates 14 by welding or with adhesives.

Baffle insert 10 may be sized to form a snug fit in reservoir body 12. Alternatively, baffle insert 10 may be sized to form a loose fit in reservoir body 12, thereby further enhancing the mechanical energy absorption capability of the baffle by allowing slight movement of the baffle insert in reservoir body 12 as the container liquid ink sloshes from side-to-side. Such movement of the baffle insert is preferably primarily in the direction of print head carriage motion as indicated by double headed arrow 20.

Figure 3:
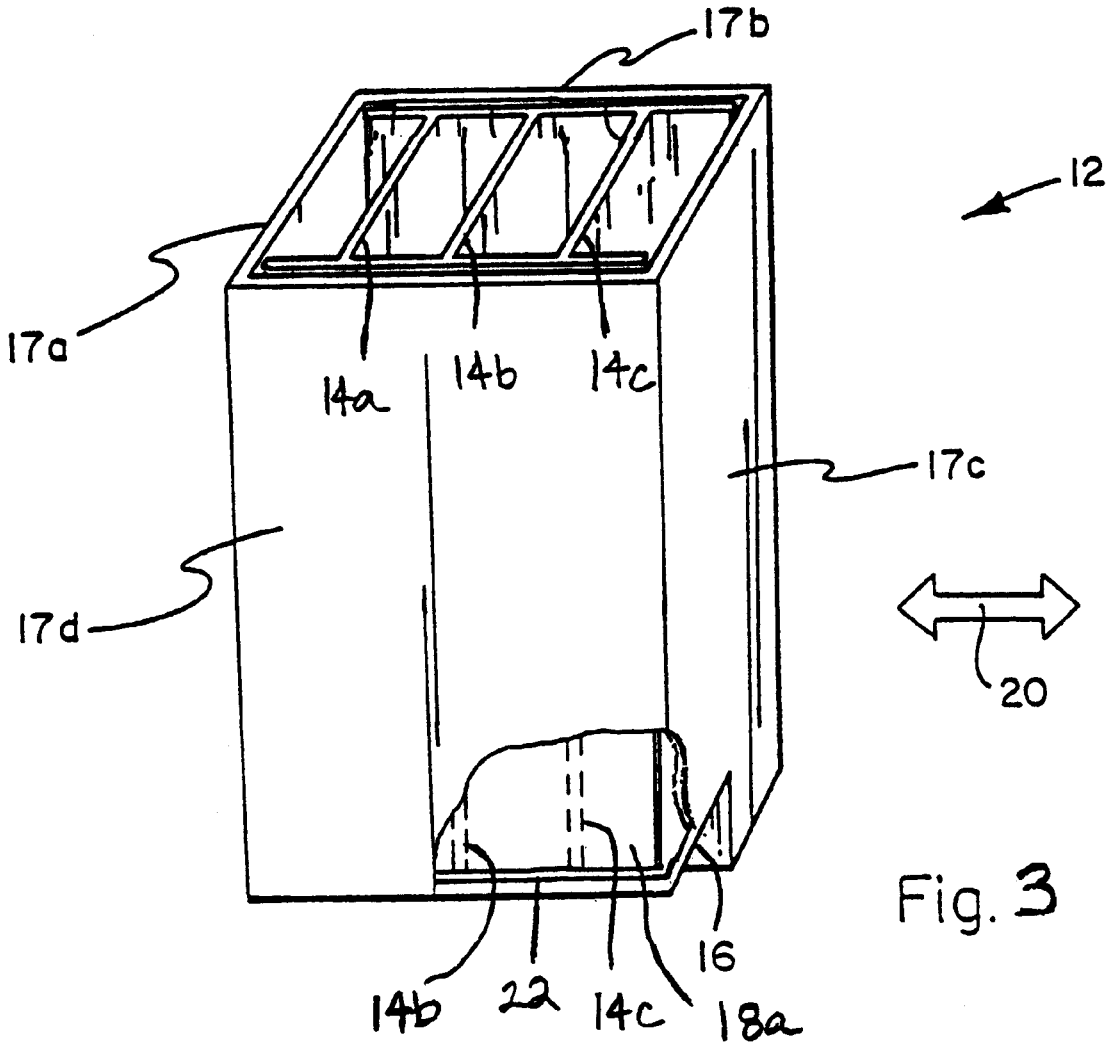
FIG. 3 is a perspective view of the baffle assembly shown in FIG. 1, with the baffle insert inserted within the reservoir body.

The baffle plates 14 of baffle insert 10 loosely divide the reservoir volume into smaller compartments. Ink flow between the compartments can be insured with strategically placed slots or holes in the baffle walls or by maintaining a loose fit, or gap 22 (FIG. 3), between the lower edge of each of the baffle elements 14*a*–14*c* and floor 16.

Baffle assembly 10 is preferably designed using the criteria set forth below. A critical dimension in the design of an effective baffle is the distance between adjacent baffle plates 14*a* and 14*b*, the distance between adjacent baffle plates 14*b* and 14*c*, the distance between the outer baffle plate 14*a* and adjacent reservoir body wall 17*a*, and the distance between outer baffle plate 14*c* and adjacent reservoir body wall 17*c*, in the direction parallel to print carriage motion indicated by double headed arrow 20. This is because the maximum acceleration sustained by the print cartridge during operation usually occurs when the carriage reverses direction between print swaths.

This acceleration can be precisely determined by employing an accelerometer or is given approximately by the formula:

$$a=2v/t,$$

wherein:

a=acceleration experienced by the print cartridge when the carriage changes direction;

v=printer carriage velocity; and t=time required for the printer carriage to change directions between printed swaths.

The condition on the baffle spacing is given by the simple inequality:

$$dab<Dp,$$

wherein:

d=ink mass density;

a=acceleration experienced by the print cartridge when the carriage changes direction;

b=baffle spacing in the direction parallel to the carriage motion; and

Dp=maximum acceptable amplitude of pressure impulse, where the upper case D denotes a change in pressure from the relatively constant hydrostatic ink pressure in the print cartridge reservoir.

The amplitude Dp of the pressure impulse is conveniently expressed as an equivalent change in hydrostatic pressure:

$$Dp=dgDh,$$

wherein:

Dp=maximum acceptable amplitude of pressure impulse;

d=ink mass density;

g=local acceleration of gravity (approximately 980 cm/sec^2); and

Dh=hydrostatic pressure equivalent to the maximum acceptable pressure impulse amplitude.

The inequality for the baffle spacing b can therefore be rewritten as:

$$b<(g/a)Dh,$$

wherein:

b=baffle spacing in the direction parallel to the carriage motion;

g=local acceleration of gravity (approximately 980 cm/sec^2);

a=acceleration experienced by the print cartridge when the carriage changes direction; and Dh=hydrostatic pressure equivalent to the maximum acceptable pressure impulse amplitude.

Figure 2:
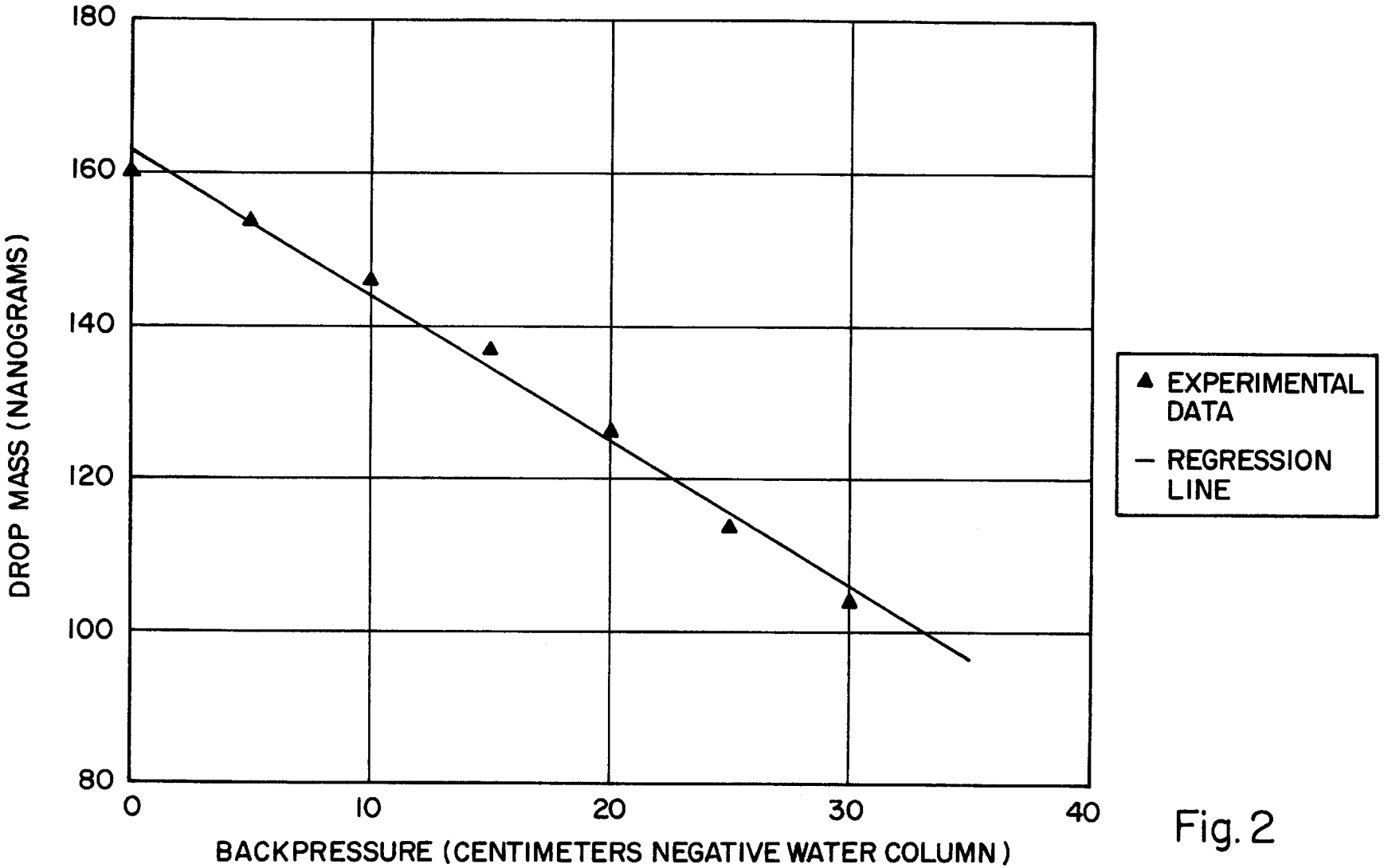
FIG. 2 shows a graph depicting the relationship between ejected ink drop mass and reservoir pressure.

The effect of an impulsive pressure change on print quality can be assessed experimentally. The principle effect on print quality of change in reservoir pressure is reflected in a change in the mass of an expelling ink droplet. Since a pressure impulse is by nature a wave phenomenon, it can manifest itself as particularly visible variation in print density. The relationship between ejected ink drop mass and reservoir pressure can be described by a straight line with slope k, as shown in FIG. 2.

$$k=Dm/Dh,$$

wherein:

k=regression slope of the graph of drop mass versus reservoir pressure;

Dm=change in ejected drop mass due to a change in reservoir pressure (drop mass); and Dh=hydrostatic pressure equivalent to the maximum acceptable pressure impulse amplitude (backpressure).

The magnitude of the effect varies with the particular print element and its operating conditions. However, a representative value for the constant slope k is: k is approximately 2 nanograms change in ink mass per centimeter change in hydrostatic reservoir pressure.

If it is judged that a variation in drop mass of magnitude Dm is barely acceptable, then the distance b between baffles (in the direction perpendicular with carriage motion) can be chosen so that the reservoir experiences changes in hydrostatic pressure no larger than a value Dh, to satisfy the inequality:

$$2Dh<Dm/k.$$

The factor of two is necessary because the wave nature of the pressure impulse causes the hydrostatic pressure to vary by an amount Dh both above and below the equilibrium reservoir pressure.

The distance b between baffles required to attenuate variations in drop mass below the threshold value Dm therefore must satisfy the inequality:

$$b<(g/a)Dm/2k,$$

wherein:

b=baffle spacing in the direction parallel to the carriage motion;

g=local acceleration of gravity (approximately 980 cm/sec^2);

a=acceleration experienced by the print cartridge when the carriage changes direction;

Dm=change in ejected drop mass due to a change in reservoir pressure; and k=regression slope of the graph of drop mass versus reservoir pressure.

The design criteria set forth above may be used to design a baffle insert which fits snugly in the ink reservoir, or, as in some embodiments, is sized to form a loose fit in the ink reservoir.

DESIGN EXAMPLE

Suppose that an ink jet printer with 300 dots per inch print resolution operates the print element at 6000 dots per second. The resultant carriage speed would be:

$$v=20 \text{ inch/second}=50.8 \text{ centimeters/second},$$

wherein v=printer carriage velocity.

A reasonable time for the carriage direction reversal is 50 milliseconds;

therefore, $$a = 2v/t = 2(50.8 \text{ cm}/s)/(0.050s)$$

$$= 2032 \text{ cm}/s$$

$$a/g = (2032 \text{ cm}/s\text{^}2)/(980 \text{ cm}/s\text{^}2)$$

$$= 2.07.$$

Further suppose that a barely tolerable change in drop mass is 15 nanograms and that the slope k is 2 nanograms per centimeter hydrostatic pressure. Then $$(g/a)Dm/2k = (2.07)(15ng)/(2(2ng/\text{cm}))$$

$$= 1.8 \text{ cm}.$$

Therefore, the baffle spacing must conform to the following inequality to insure that intolerable variations in drop mass do not occur, i.e. b<1.8 centimeters, wherein b=baffle spacing in the direction parallel to the carriage motion.

The values for the variables used in the equations above are dependent upon factors associated with the printer mechanism, printer cartridge and/or ink being used. For example, acceleration (a) is dependent upon the physical characteristics of the printer mechanism, and in particular, the printhead carriage; backpressure (Dh) and the slope (k) will be dependent upon the physical characteristics of the printer cartridge; and the variation in drop mass (Dm) will be dependent upon, for example, the type of print medium, the size of the ink jet nozzles, and the spacing between the print medium and the ink jet nozzles. Typical parameters ranges for these variables are:

a=700 to 7000 centimeters per second^2;

a/g=0.5 to 10;

Dm=2 to 40 nanograms;

Dh=0.5 to 20 centimeters water column; and k=0.2 to 6 nanograms per cemtimeter water column.

Additional advantages of the invention may be obtained by manufacturing the insertable baffle 10 from a material different from that of the ink supply reservoir body 12. For example, a lower cost material may be chosen, since restrictions on the dimensional and structural integrity of the baffle are not as stringent as for the ink supply body 12. Furthermore, a more compliant material may be chosen, thereby enhancing the effectiveness of the baffle as a slosh attenuator.

By selecting a material for baffle insert 10 which is a complaint material, i.e. having somewhat fexible or pliable characteristics, the effectiveness of baffle insert 10 as a slosh attenuator is enhanced by absorbing some of the mechanical energy of the sloshing liquid. Accordingly, shock impulses generated when the ink comes in contact with the baffle are reduced since the baffle plates 14 are allowed to flex upon contact. Accordingly, in preferred embodiments of the invention, baffle insert 10 is manufactured from a compliant material, such as for example plastic, rubber or metal. The thickness of the baffle plates is chosen, based upon the material selected, so that the baffle plates have the desired compliancy.

Although the invention has been described with reference to preferred embodiments, workers skilled in the art will recognize that changes may be made in form and detail without departing from the spirit and scope of the following claims.

What is claimed is:

1. A baffle assembly for insertion into an ink supply reservoir having a pair of opposing sidewalls, comprising:

a first baffle plate having a first end and a second end;

a first end plate coupled to and extending in a transverse direction relative to the first end of said first baffle plate, said first end plate being configured for extending from and between the pair of sidewalls in the transverse direction; and a second end plate coupled to and extending in a transverse direction relative to the second end of said first baffle plate, said second end plate being configured for extending from and between the pair of sidewalls in the transverse direction.

2. The baffle assembly of claim 1, wherein said first baffle plate, said first end plate, and said second end plate form an integral structure.

3. The baffle assembly of claim 1, wherein said baffle plate loosely divides a volume of said ink supply reservoir into a plurality of smaller compartments, and wherein an ink flow between said plurality of compartments is provided by a gap between said first baffle plate and a floor wall of said ink supply reservoir.

4. The baffle assembly of claim 1, wherein said baffle plate is formed from a material different from a material from which said ink supply reservoir is formed.

5. The baffle assembly of claim 1, wherein said first baffle plate is formed from a compliant material.

6. The baffle assembly of claim 5, wherein said compliant material is selected from a group consisting of plastic, rubber and metal.

7. The baffle assembly of claim 1, wherein said baffle assembly is formed from a compliant material.

8. The baffle assembly of claim 1, wherein said baffle assembly is sized to allow said baffle assembly to move in said ink supply reservoir in a direction parallel to a direction of motion of said printer cartridge.

9. The baffle assembly of claim 1, further comprising a second baffle plate arranged substantially parallel to said first baffle plate, said second baffle plate having a first end and a second end, wherein said first end plate is coupled to the first end of said second baffle plate and said second end plate is coupled to the second end of said second baffle plate.

10. The baffle assembly of claim 9, wherein said first baffle plate, said second baffle plate, said first end plate, and said second end plate form an integral structure.

11. The baffle assembly of claim 9, wherein said first and second baffle plates loosely divide a volume of said ink supply reservoir into a plurality of smaller compartments, and wherein an ink flow between said plurality of compartments is provided by a gap between said first and second baffle plates and a floor of said ink supply reservoir.

12. The baffle assembly of claim 9, wherein said first and second baffle plates are formed from a material different from a material from which said ink supply reservoir is formed.

13. The baffle assembly of claim 9, wherein said first and second baffle plates are formed from a compliant material.

14. The baffle assembly of claim 13, wherein said compliant material is selected from a group consisting plastic, rubber and metal.

15. The baffle assembly of claim 9, wherein said baffle assembly is sized to allow said assembly to move in said ink supply reservoir in a direction parallel to a direction of motion of said printer cartridge.

16. The baffle assembly of claim 1, wherein said ink supply reservoir includes a floor wall interconnecting said pair of opposing sidewalls, said first baffle plate being disposed substantially perpendicular to said floor wall.

17. The baffle assembly of claim 1, wherein said baffle assembly is constructed from a substantially non-porous material.

18. A baffle assembly for insertion into an ink supply reservoir, comprising:

a first baffle-plate having a first end and a second end;

a first end plate coupled to the first end of said first baffle plate; and a second end plate coupled to the second end of said first baffle plate;

wherein when said baffle assembly is inserted into said ink supply reservoir, a distance, b, between said first baffle plate and an adjacent sidewall of said ink supply reservoir satisfies the inequality relationship $b<(g/a)Dm/2k$, wherein:

g is the local acceleration of gravity, a is the acceleration experienced by said ink supply reservoir during a change in a travel direction, Dm is the change in an ejected ink drop mass due to a change in an ink reservoir pressure in said ink supply reservoir, and k is a slope of a graph of said ink drop mass versus said ink reservoir pressure.

19. A baffle assembly for insertion into an ink supply reservoir, comprising:

a first baffle plate having a first end and a second end;

a first end plate coupled to the first end of said first baffle plate; and a second end plate coupled to the second end of said first baffle plate;

wherein when said baffle assembly is inserted into said ink supply reservoir, a distance, b, between said first baffle plate and an adjacent sidewall of said ink supply reservoir satisfies the inequality relationship $b<(g/a)Dh$, wherein:

g is the local acceleration of gravity (approximately 980 cm/sec^2);

a is the acceleration experienced by the baffle assembled during a change in travel direction; and Dh is the hydrostatic pressure equivalent to the maximum acceptable pressure impulse amplitude.

20. A baffle assembly for insertion into an ink supply reservoir, comprising:

a first baffle plate having a first end and a second end;

a second baffle plate arranged substantially parallel to said first baffle plate, said second baffle plate having a first end and a second end;

a first end plate coupled to the first end of each of said first baffle plate and said second baffle plate; and a second end plate coupled to the second end of each of said first baffle plate and said second baffle plate;

wherein a distance, b, between said first baffle plate and said second baffle plate satisfies the inequality relationship $b<(g/a)Dm/2k$, wherein:

g is the local acceleration of gravity, a is the acceleration experienced by said ink supply reservoir during a change in a travel direction, Dm is the change in an ejected ink drop mass due to a change in an ink reservoir pressure in said ink supply reservoir, and K is a slope of said ink drop mass versus said ink reservoir pressure.

21. A baffle assembly for insertion into an ink supply reservoir, comprising:

a first baffle plate having a first end and a second end;

a second baffle plate arranged substantially parallel to said first baffle plate, said second baffle plate having a first end and a second end;

a first end plate coupled to the first end of each of said first baffle plate and said second baffle plate; and a second end plate coupled to the second end of each of said first baffle plate and said second baffle plate;

wherein a distance, b, between said first baffle plate and said second baffle plate is given by the relationship $b<(g/a)Dh$, wherein:

g is the local acceleration of gravity (approximately 980 cm/sec^2);

a is the acceleration experienced by the printer cartridge during a change in travel direction; and Dh is the hydrostatic pressure equivalent to the maximum acceptable pressure impulse amplitude.

22. A printer cartridge, comprising:

a reservoir body forming a container for storing a supply of ink and having a pair of opposing sidewalls; and a baffle assembly positioned in said reservoir body, said baffle assembly including:

a first baffle plate having a first end and a second end;

a first end plate coupled to and extending in a transverse direction relative to the first end of said first baffle plate, said first end plate extending from and between the pair of sidewalls in the transverse direction; and a second end plate coupled to and extending in a transverse direction relative to the second end of said first baffle plate, said second end plate extending from and between the pair of sidewalls in the transverse direction.

23. The baffle assembly of claim 22, wherein said first baffle plate, said first end plate, and said second end plate form an integral structure.

24. The baffle assembly of claim 22, wherein said first baffle plate loosely divides a volume of said reservoir body into a plurality of smaller compartments, and wherein an ink flow between said plurality of compartments is provided by a gap between said first baffle plate and a floor wall of said reservoir body.

25. The baffle assembly of claim 22, wherein said first baffle plate is formed from a material different from a material from which said reservoir body is formed.

26. The baffle assembly of claim 22, wherein said assembly is sized to allow said assembly to move in said reservoir body a direction parallel to a direction of motion of a printer carriage.

27. The baffle assembly of claim 22, further comprising a second baffle plate arranged substantially parallel to said first baffle plate, said second baffle plate having a first end and a second end, wherein said first end plate is coupled to the first end of said second baffle plate and said second end plate is coupled to the second end of said second baffle plate.

28. A printer cartridge, comprising:

an ink supply reservoir; and a baffle assembly for insertion into said ink supply reservoir, said baffle assembly including a baffle plate which divides said ink supply reservoir into a plurality of compartments, wherein a distance, b, between said baffle plate and an adjacent sidewall of said ink supply reservoir satisfies the inequality relationship $b<(g/a)Dm/2k$, wherein:

g is the local acceleration of gravity, a is the acceleration experienced by said ink supply reservoir during a change in a travel direction, Dm is the change in an ejected ink drop mass due to a change in an ink reservoir pressure in said ink supply reservoir, and k is the slope of the graph of said ink drop mass versus said ink reservoir pressure.

29. A printer cartridge, comprising:

an ink supply reservoir; and a baffle assembly for insertion into said ink supply reservoir, said baffle assembly including a baffle plate which divides said ink supply reservoir into a plurality of compartments, wherein a distance, b, between said baffle plate and an adjacent sidewall of said ink supply reservoir satisfies the inequality relationship $b<(g/a)Dh$, wherein:

g is the local acceleration of gravity, a is the acceleration experienced by said ink supply reservoir during a change in a travel direction, Dh is the hydrostatic pressure equivalent to the maximum acceptable pressure impulse amplitude.

30. A printer cartridge, comprising:

an ink supply reservoir; and a baffle assembly positioned in said ink supply reservoir, said baffle assembly including a first baffle plate and a second baffle plate, wherein a distance, b, between said first baffle plate and said second baffle plate satisfies the inequality relationship $b<(g/a)Dm/2k$, wherein:

g is the local acceleration of gravity, a is the acceleration experienced by said ink supply reservoir during a change in a travel direction, Dm is the change in an ejected ink drop mass due to a change in an ink reservoir pressure in said ink supply reservoir, and k is the slope of the graph of said ink drop mass versus said ink reservoir pressure.

31. A printer cartridge, comprising:

a reservoir body forming a container for storing a supply of ink; and a baffle assembly positioned in said reservoir body, wherein a distance, b, between said first baffle plate and said second baffle plate satisfies the inequality relationship $b<(g/a)Dh$, wherein:

g is the local acceleration of gravity (approximately 980 cm/sec^2);

a is the acceleration experienced by said reservoir body during a change in a travel direction; and Dh is the hydrostatic pressure equivalent to the maximum acceptable pressure impulse amplitude.

* * * * *